US011130013B2

(12) United States Patent
Tabone

(10) Patent No.: US 11,130,013 B2
(45) Date of Patent: Sep. 28, 2021

(54) MULTI-PURPOSE EXERCISE APPARATUS

(71) Applicant: C&E TOOLING, INC., North Las Vegas, NV (US)

(72) Inventor: Paul Tabone, Las Vegas, NV (US)

(73) Assignee: C&E TOOLING, INC.

( * ) Notice: Subject to any disclaimer, the term of this patent is extended or adjusted under 35 U.S.C. 154(b) by 217 days.

(21) Appl. No.: 16/594,606

(22) Filed: Oct. 7, 2019

(65) Prior Publication Data

US 2020/0114193 A1 Apr. 16, 2020

Related U.S. Application Data

(60) Provisional application No. 62/744,176, filed on Oct. 11, 2018.

(51) Int. Cl.
*A63B 21/072* (2006.01)

(52) U.S. Cl.
CPC ..... *A63B 21/0728* (2013.01); *A63B 21/0724* (2013.01)

(58) Field of Classification Search
CPC ..... A63B 21/0728; A63B 21/0724; A63B 21/0783; A63B 2225/10; A63B 71/0036; A63B 71/0054; A63B 2225/09
See application file for complete search history.

(56) References Cited

U.S. PATENT DOCUMENTS 2,529,347 A * 11/1950 Ross, Jr. ..... A63B 21/0004 482/126
D262,730 S * 1/1982 Lambert, Jr. ..... D21/694
4,569,105 A * 2/1986 Weider ..... A63B 21/0728 24/544
4,629,184 A * 12/1986 Selkee ..... A63B 21/0724 482/106
4,639,979 A * 2/1987 Polson ..... A63B 21/0728 24/273
4,822,035 A 4/1989 Jennings et al.
4,865,314 A * 9/1989 Carter, Jr. ..... A63B 21/0724 482/106

(Continued)

OTHER PUBLICATIONS

Rogue Fitness website, https://www.roguefitness.com/landmines?prod_id=1763&gclid=Cj0KCQjwuNbsBRC-ARIsAAzITue4df8WDjYUOJ0k8rFJM_nZqZHFvb8dWMAQUIK67FOSm8Pb8sCdA1AaAo8zEALw_wcB; Retrieved Oct. 7. 2019, pp. 1-7.

(Continued)

*Primary Examiner* — Garrett K Atkinson
(74) *Attorney, Agent, or Firm* — The Belles Group, P.C.

(57) ABSTRACT

A multi-purpose exercise apparatus having a central hub. The central hub has a central plane and a bar bell aperture configured to receive a portion of a bar bell. A first arm is pivotably coupled to the central hub so as to be rotatable about a first arm pivot axis between a plurality of selectable first arm angular positions. A first gripping member is pivotably coupled to the first arm so as to be rotatable about a first handle pivot axis between a plurality of selectable first gripping angular positions. A second arm is pivotably coupled to the central hub so as to be rotatable about a second arm pivot axis between a plurality of selectable second arm angular positions. A second gripping member is pivotably coupled to the second arm to be rotatable about a second handle pivot axis between a plurality of selectable second gripping angular positions.

20 Claims, 16 Drawing Sheets

(56) References Cited

U.S. PATENT DOCUMENTS

| | | | | | |
|---|---|---|---|---|---|
| D305,256 | S * | 12/1989 | Pearson | D21/682 | |
| 4,943,052 | A * | 7/1990 | Powers | A63B 21/0724 | 482/106 |
| 5,490,825 | A | 2/1996 | Wilkinson | | |
| 5,674,164 | A * | 10/1997 | Kravitz | A63B 21/0004 | 482/121 |
| 5,690,596 | A * | 11/1997 | Parker | A63B 21/0004 | 482/121 |
| D404,094 | S * | 1/1999 | Ho | D21/684 | |
| 6,371,893 | B1 * | 4/2002 | Redden | A63B 21/065 | 482/104 |
| 7,056,268 | B2 | 6/2006 | Emick | | |
| D563,491 | S * | 3/2008 | Kaplan | D21/692 | |
| 7,553,259 | B2 | 6/2009 | Landfair | | |
| 7,828,704 | B1 * | 11/2010 | Hsieh | A63B 23/12 | 482/126 |
| 8,951,171 | B2 * | 2/2015 | Leach | A63B 21/0728 | 482/107 |
| 9,084,913 | B2 * | 7/2015 | Davies, III | A63B 21/0728 | |
| 9,095,743 | B2 * | 8/2015 | Davies, III | A63B 21/0728 | |
| 9,138,610 | B2 * | 9/2015 | Lovegrove | A63B 21/0728 | |
| 9,211,430 | B1 * | 12/2015 | Higginbotham, III | A63B 23/0355 | |
| 9,522,296 | B2 * | 12/2016 | Davies, III | A63B 21/15 | |
| 9,713,733 | B2 * | 7/2017 | Dennis | A63B 21/4047 | |
| 9,855,458 | B2 * | 1/2018 | Stilson | A63B 21/0728 | |
| 9,925,407 | B2 * | 3/2018 | Davies, III | A63B 21/15 | |
| 10,004,970 | B1 * | 6/2018 | Mailander | A63B 21/4035 | |
| 10,022,582 | B2 * | 7/2018 | Gangemi | A63B 21/00065 | |
| 10,086,225 | B2 * | 10/2018 | Sheppard | A63B 21/0722 | |
| 10,226,659 | B2 * | 3/2019 | Stilson | A63B 21/0724 | |
| D864,317 | S * | 10/2019 | Higginbotham, III | D21/673 | |
| D874,585 | S * | 2/2020 | Pellegrino | D21/694 | |
| D892,239 | S * | 8/2020 | Carmichael | D21/694 | |
| 10,779,665 | B2 * | 9/2020 | Durfee | A63B 21/4027 | |
| 10,792,534 | B2 * | 10/2020 | Klecka | A63B 21/0724 | |
| 10,953,263 | B2 * | 3/2021 | Stilson | A63B 21/0728 | |
| 2006/0276314 | A1 | 12/2006 | Wilson et al. | | |
| 2017/0144011 | A1 * | 5/2017 | Gangemi | A63B 21/0724 | |
| 2017/0144012 | A1 * | 5/2017 | Stilson | A63B 21/0724 | |
| 2018/0140890 | A1 * | 5/2018 | Sheppard | A63B 21/0726 | |
| 2018/0147439 | A1 * | 5/2018 | Woods | A63B 21/0728 | |
| 2019/0105525 | A1 * | 4/2019 | Stilson | A63B 21/0724 | |
| 2019/0275365 | A1 * | 9/2019 | Bongelli | A63B 69/20 | |
| 2019/0351280 | A1 * | 11/2019 | Klecka | A63B 21/4035 | |
| 2020/0188723 | A1 * | 6/2020 | Reibman | A63B 21/4035 | |
| 2020/0206559 | A1 * | 7/2020 | Gangemi | A63B 21/0724 | |

OTHER PUBLICATIONS

Titan Fitness website, https://www.titan.fitness/strength/strength-accessories/landmines/neutral-grip-viking-press-handle-%7C-v2-welded-end-cap/400304.html?utm_source=google&utm_medium=cpc&adpos=1o1&scid=scp1p400304&sc_intid=400304&gclid=Cj0KCQjwuNbsBRC-ARIsAAzITuezqKHIruUYm6tucjfCC2IEpcCxhcfVSGW0S3R4VbOgrDE_W6zW7DMaArkqEALw_wcB, retrieved Oct. 7, 2019, pp. 1-3.

Rogue Fitness website, https://www.roguefitness.com/rogue-tricep-pushdown-attachment, retrieved Oct. 7, 2019, pp. 1-4.

Rogue Fitness website, https://www.roguefitness.com/spud-inc-lat-saw-kits?prod_id=75109&gclid=Cj0KCQjwuNbsBRC-ARIsAAzITuc_8d0GGeepLBX6PW7NYY8Nxus-huN1RagpXoA6WA11GT_fZu2h1qcaAvpiEALw_wcB, retrieved Oct. 7, 2019, pp. 1-3.

Pukensvet website, https://pukensvet.com/product/weight-lifting-equipment/bars-handles-hooks/adjustable-squat-handles/, retrieved Oct. 7, 2019, pp. 1-4.

* cited by examiner

MULTI-PURPOSE EXERCISE APPARATUS

CROSS-REFERENCE TO RELATED PATENT APPLICATIONS

The present application claims priority to U.S. Provisional Patent Application Ser. No. 62/744,176, filed Oct. 11, 2018, the entirety of which is incorporated herein by reference.

BACKGROUND

When lifting weights, there are an inordinate number of attachment bars required to exercise all of a user's different muscles. For example, there are triceps pull down ropes, triceps pull down and press down bars, multi-purpose V-bars, stirrup handles, straight bars, curvy bars, single and double D bars, Lat bars, chinning triangles, single cable grips, multi-purpose bars, and the like. Furthermore, there are countless variations available for each different type of attachment bar. Each bar has a purpose and is generally used for one or two different exercises and/or to exercise one or two different muscle groups. Additionally, separate holders or racks are required to hold or retain barbells, such as a bench press barbell, when it is not in use or when performing exercises that begin from the floor such as a dead lift. There is a need for a singular device that can be used for performing most if not all weight lifting exercises desired by a user while also having the ability to function as a bar jack.

BRIEF SUMMARY

The present invention is directed to a multi-purpose exercise apparatus having a central hub. The central hub has a central plane and a bar bell aperture configured to receive a portion of a bar bell. A first arm is pivotably coupled to the central hub so as to be rotatable about a first arm pivot axis between a plurality of selectable first arm angular positions. A first gripping member is pivotably coupled to the first arm so as to be rotatable about a first handle pivot axis between a plurality of selectable first gripping angular positions. A second arm is pivotably coupled to the central hub so as to be rotatable about a second arm pivot axis between a plurality of selectable second arm angular positions. A second gripping member is pivotably coupled to the second arm to be rotatable about a second handle pivot axis between a plurality of selectable second gripping angular positions.

In one aspect, the invention may be a multi-purpose exercise apparatus comprising: a central hub having a central plane and a bar bell aperture, the bar bell aperture extending along a central axis that lies within the central plane and configured to slidably receive a weight bearing portion of a bar bell; a first arm extending along a first arm axis and pivotably coupled to the central hub so as to be rotatable about a first arm pivot axis between a plurality of selectable first arm angular positions; a first gripping member pivotably coupled to the first arm so as to be rotatable about a first handle pivot axis between a plurality of selectable first gripping angular positions; a second arm extending along a second arm axis and pivotably coupled to the central hub so as to be rotatable about a second arm pivot axis between a plurality of selectable second arm angular positions; and a second gripping member pivotably coupled to the second arm so as to be rotatable about a second handle pivot axis between a plurality of selectable second gripping angular positions.

In another aspect, the invention may be a multi-purpose exercise apparatus comprising: a central hub having a central plane; a first arm extending along a first arm axis and pivotably coupled to the central hub on a first side of the central plane so as to be rotatable about a first arm pivot axis between a plurality of selectable first arm angular positions; a first arm locking element alterable between a first arm locked state in which the first arm is locked into a selected one of the plurality of selectable first arm angular positions and a first arm unlocked state in which the first arm can freely rotate between the plurality of selectable first arm angular positions; a second arm extending along a second arm axis and pivotably coupled to the central hub on a second side of the central plane so as to be rotatable about a second arm pivot axis between a plurality of selectable second arm angular positions; and a second arm locking element alterable between a second arm locked state in which the second arm is locked into a selected one of the plurality of selectable second arm angular positions and a second arm unlocked state in which the second arm can freely rotate between the plurality of selectable second arm angular positions.

In yet another aspect, the invention may be a multi-purpose exercise apparatus comprising: a central hub having a central plane and a bar bell aperture, the bar bell aperture extending along a central axis that lies within the central plane and configured to slidably receive a weight bearing portion of a bar bell; a cable attachment member extending from the central hub and located along the central plane, the cable attachment member comprising a cable clip aperture configured to be detachably coupled to a cable clip; a first hook member extending upward from the central hub obliquely relative to the central plane, the first hook member defining a first slot configured to receive a grip section of the bar bell; a second hook member extending upward from the central hub obliquely relative to the central plane on an opposite side of the central plane as the first hook member, the second hook member defining a second slot configured to receive the grip section of the bar bell; a first arm comprising a first end and a second end, the first end being coupled to the central hub; a first gripping member coupled to the second end of the first arm; a second arm comprising a first end and a second end, the first end being coupled to the central hub; and a second gripping member coupled to the second end of the second arm.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
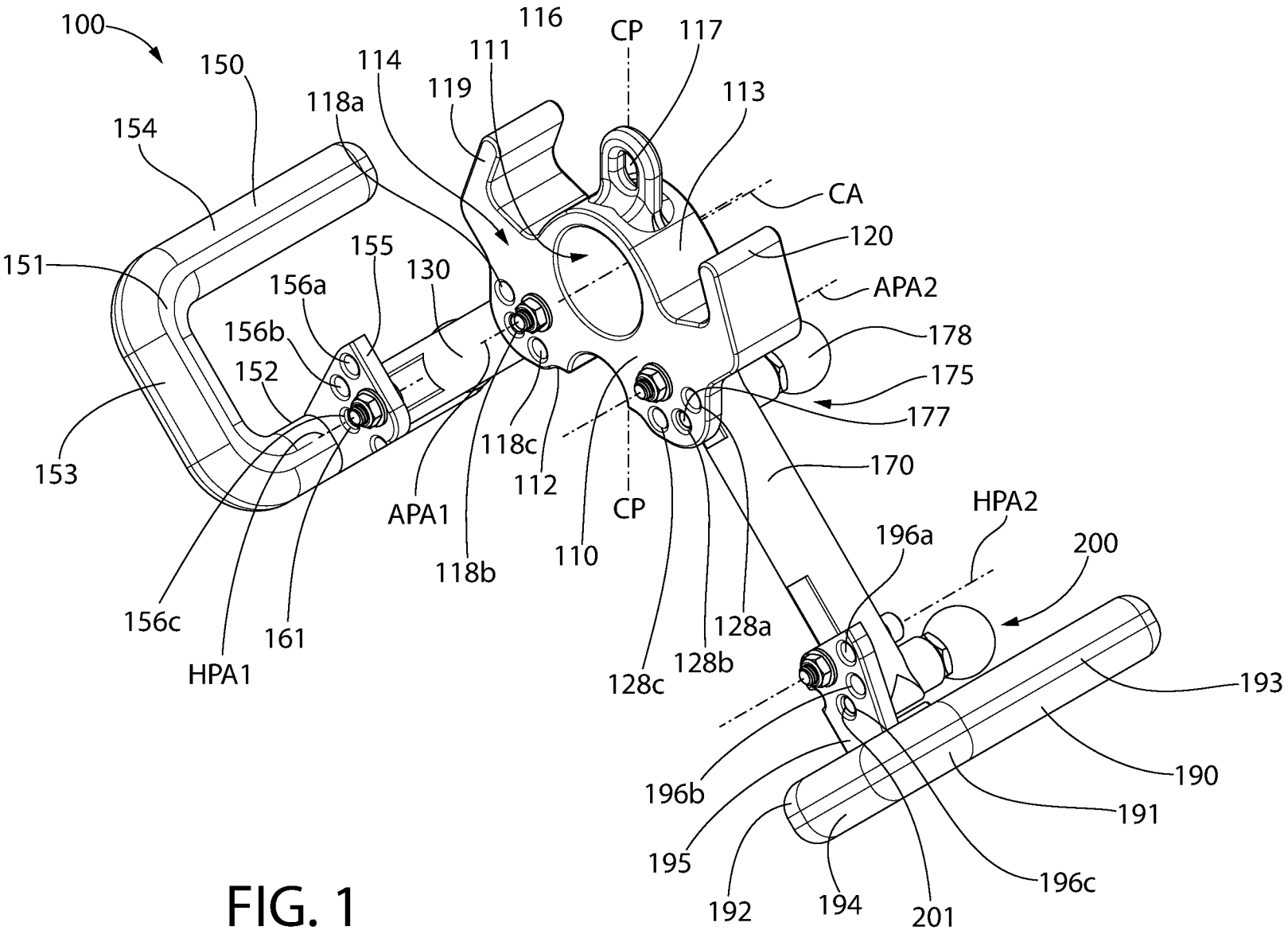
FIG. 1 is a front perspective view of a multi-purpose exercise apparatus having a central hub, a first arm, a first gripping member, a second arm, and a second gripping member in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIGS. 1-5 concurrently, a multi-purpose exercise apparatus (hereinafter "the apparatus") 100 will be described in accordance with an embodiment of the present invention. The apparatus 100 generally comprises a central hub 110, a first arm 130 pivotably coupled to the central hub 110, a first gripping member 150 pivotably coupled to the first arm 130, a second arm 170 pivotably coupled to the central hub 110, and a second gripping member 190 pivotably coupled to the second arm 170. Thus, the first and second arms 130, 170 are pivotable/rotatable relative to the central hub 110 and the first and second gripping members 150, 190 are pivotable/rotatable relative to the first and second arms 130, 170, respectively. This provides great versatility to the apparatus 100 so that it can be used by a person lifting weights or working out to perform multiple different exercises on multiple different muscle groups. Furthermore, the central hub 110 comprises features that enable it to be connected to various different mechanisms including a cable of a weight machine, directly to a bar bell, or the like. The structural details of each of the aforementioned parts of the apparatus 100 as well as their relative functions will be described in turn below.

Figure 13:
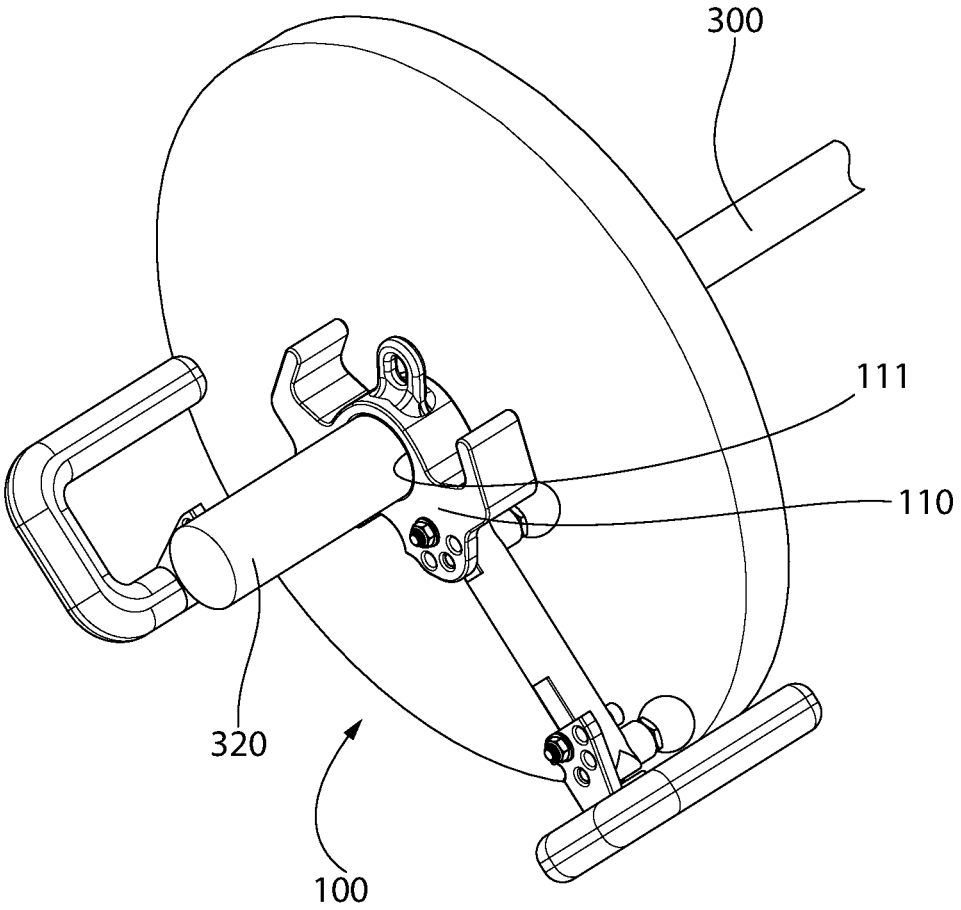
FIG. 13 is a perspective view of the multi-purpose exercise apparatus being used with a weight bearing portion of a bar bell located within a bar bell aperture thereof.

The central hub 110 is the portion of the apparatus 100 that is coupled to a weight bearing apparatus (e.g., a bar bell, a weight machine, or the like). The central hub 110 has a bottom surface 112, a top surface 113, a front surface 114, and a rear surface 115. Furthermore, the central hub 110 comprises a central plane CP-CP (extending vertically so as to intersect the bottom and top surfaces 112, 113) that divides the central hub 110 into two symmetrical halves. In the exemplified embodiment, the central hub 110 comprises a bar bell aperture 111 that extends along a central axis CA, with the central axis CA lying in the central plane CP-CP. Thus, the bar bell aperture 111 extends through the central hub 110 from the front surface 114 to the rear surface 115. The bar bell aperture 111 comprises a diameter D1 that is configured to slidably receive a weight bearing portion of a bar bell, as shown in FIG. 13 and described in greater detail below. The weight bearing portion of the bar bell is generally 2.0 inches (50 mm) in diameter, and thus the bar bell aperture 111 should be just slightly larger than that (i.e., 2.1 inches or somewhere between 51 mm and 55 mm or the like) in order to receive the weight bearing portion of the bar bell therein. Generally, a bar bell comprises two parts, a middle area that is gripped by a user and sleeves/collars at the opposing ends. As used herein, the weight bearing portion of the bar bell refers to the sleeve or collar of the bar bell, which is the portion on which weight plates are loaded.

Figure 14:
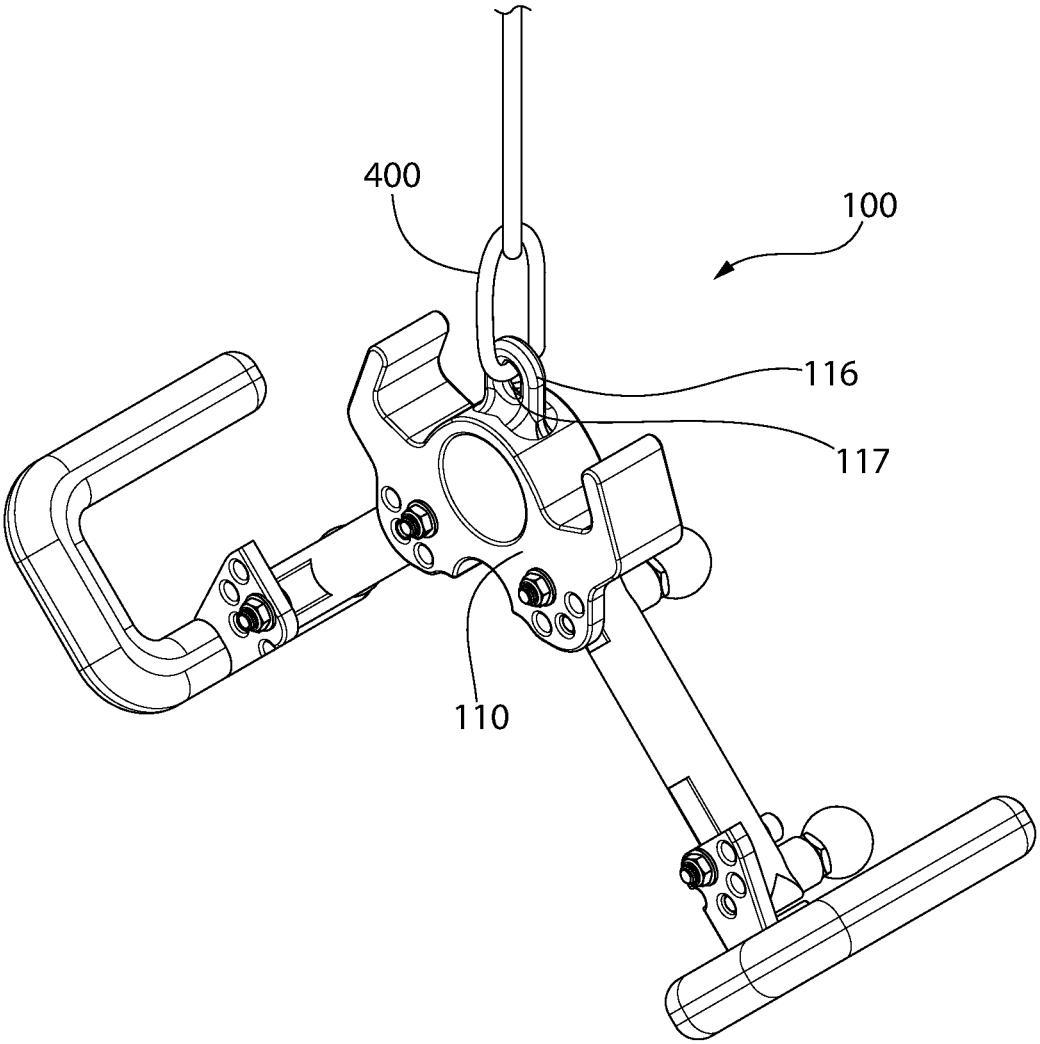
FIG. 14 is a perspective view of the multi-purpose exercise apparatus being used with a cable clip attached to a cable attachment member thereof.

Furthermore, there is a cable attachment member 116 extending from the central hub 110 and located along the central plane CP-CP of the central hub 110. The cable attachment member 116 is configured to be detachably coupled to a cable clip, such as the cable clip of a weight machine as depicted in FIG. 14 and described in greater detail below. In the exemplified embodiment, the cable attachment member 116 extends from the top surface 113 of the central hub 110. More specifically, in the exemplified embodiment the cable attachment member 116 comprises an eyelet that extends from the top surface 113 of the central hub 110 and defines a cable clip aperture 117. Thus, a cable clip of a weight machine can be inserted into and attached to the cable clip aperture 117 of the cable attachment member 116 so that the apparatus 100 can be coupled to the weight machine and used as the handle attachment during a weight lifting exercise. In the exemplified embodiment, the central axis CA of the bar bell aperture 111 is parallel to an axis of the cable clip aperture 117. Furthermore, as can be seen in the drawings, the cable clip aperture 117 has a smaller diameter and cross-sectional area as compared to the bar bell aperture 111.

Furthermore, in the exemplified embodiment there is a first hook member 119 extending upward from the central hub 110 on a first side of the central plane CP-CP and a second hook member 120 extending upward from the central hub 110 on a second side of the central plane CP-CP. The first hook member 119 defines a first slot 121 configured to receive a grip section of a bar bell. The first slot 121 comprises a floor 122 that is oriented oblique relative to the central plane CP-CP. Furthermore, the first hook member 119 extends along a first hook axis HA1 that converges towards the central plane CP-CP as it extends in a direction away from the first gripping member 150. The purpose for this orientation of the floor 122 and first hook axis HA1 will become apparent from a discussion of using the apparatus 100 as a bar jack or storage rack, as described in more detail below with reference to FIG. 12.

The second hook member 120 defines a second slot 123 that is also configured to receive a grip section of a bar bell. The second slot 123 comprises a floor 124 that is oriented oblique relative to the central plane CP-CP. Furthermore, the second hook member 120 extends along a second hook axis HA2 that converges towards the central plane C-C as it extends in a direction away from the second gripping member 170. The purpose for this orientation of the floor 124 and the second hook axis HA2 will become apparent from a discussion of using the apparatus 100 as a bar jack or storage rack, as described in more detail below with reference to FIG. 12.

Figure 12:
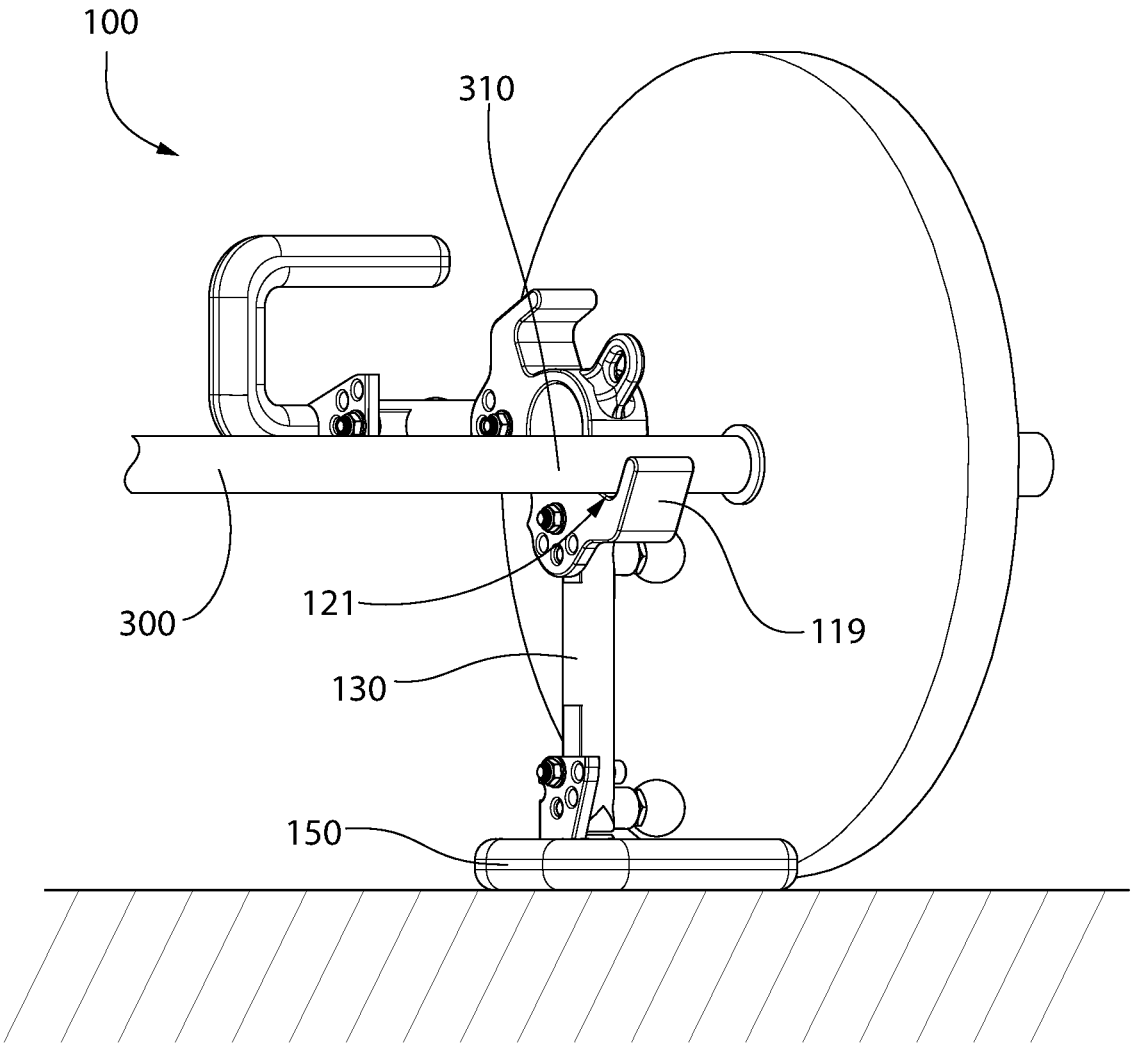
FIG. 12 is a perspective view of the multi-purpose exercise apparatus being used as a stand to support a bar bell in a storage state.

Thus, using the bar bell aperture 111, the apparatus 100 can be coupled directly to a bar bell to perform certain exercises that require such an attachment (FIG. 13). Furthermore, using the cable clip aperture 117 the apparatus 100 can be coupled directly to a weight machine via a cable clip thereof to perform certain exercises that require such an attachment (FIG. 14). The apparatus 100 can also be used as a bar jack or storage rack for a bar bell using one or both of the slots 121, 123 (FIG. 12).

As noted above, the apparatus 100 comprises a first arm 130 and a second arm 170 each of which is pivotably coupled to the central hub 110. The first and second arms 130, 170 are coupled to the central hub 110 on opposing sides of the central plane CP-CP.

The first arm 130 comprises a first end 131 and a second end 132 and extends along a first arm axis A1 from the first end 131 to the second end 132. In the exemplified embodiment, the first arm 130 has a fixed length. The first end 131 of the first arm 130 is pivotably coupled to the central hub 110. As shown in the figures, a screw and a bolt (perhaps best seen in FIGS. 6A and 6B) is used to couple the first end 131 of the first arm 130 to the central hub 110. However, as will be described in greater detail below, the first arm 130 is configured to be rotatable or pivotable relative to the central hub 110 to modify an angular position of the first arm 130. In that regard, in one particular implementation the first arm 130 may be coupled to the central hub 110 with a shoulder screw and bolt to allow for the aforementioned pivoting/rotation of the first arm 130 relative to the central hub 110 while maintaining the coupling therebetween. Of course, any other type of fastener that maintains the coupling between the first arm 130 and the central hub 110 while permitting the first arm 130 to pivot/rotate relative to the central hub 110 can be used. In the exemplified embodiment the first arm 130 is coupled to the rear surface 115 of the central hub 110.

Figure 3:
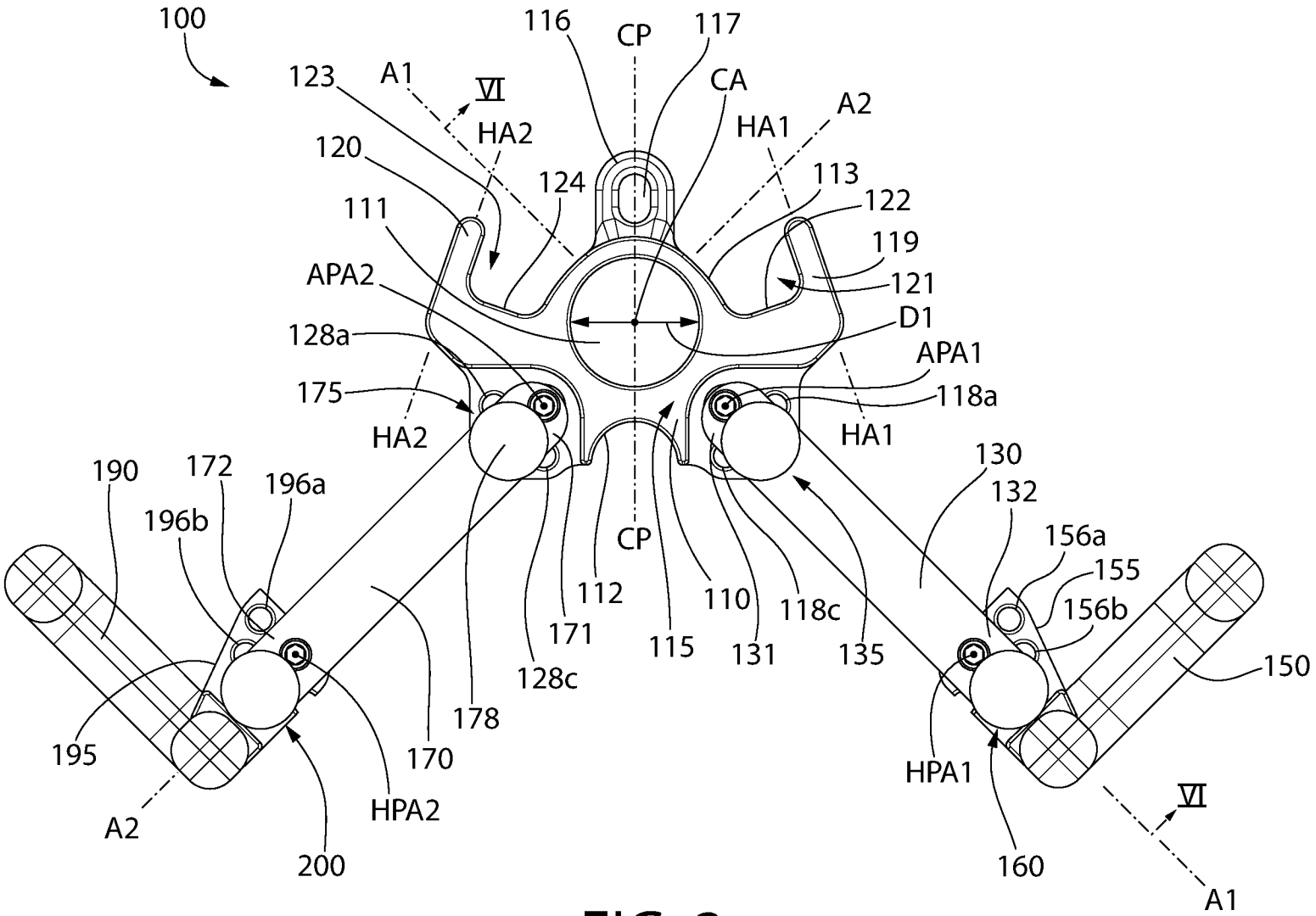
FIG. 3 is a rear view of the multi-purpose exercise apparatus of FIG. 1.
Figure 4:
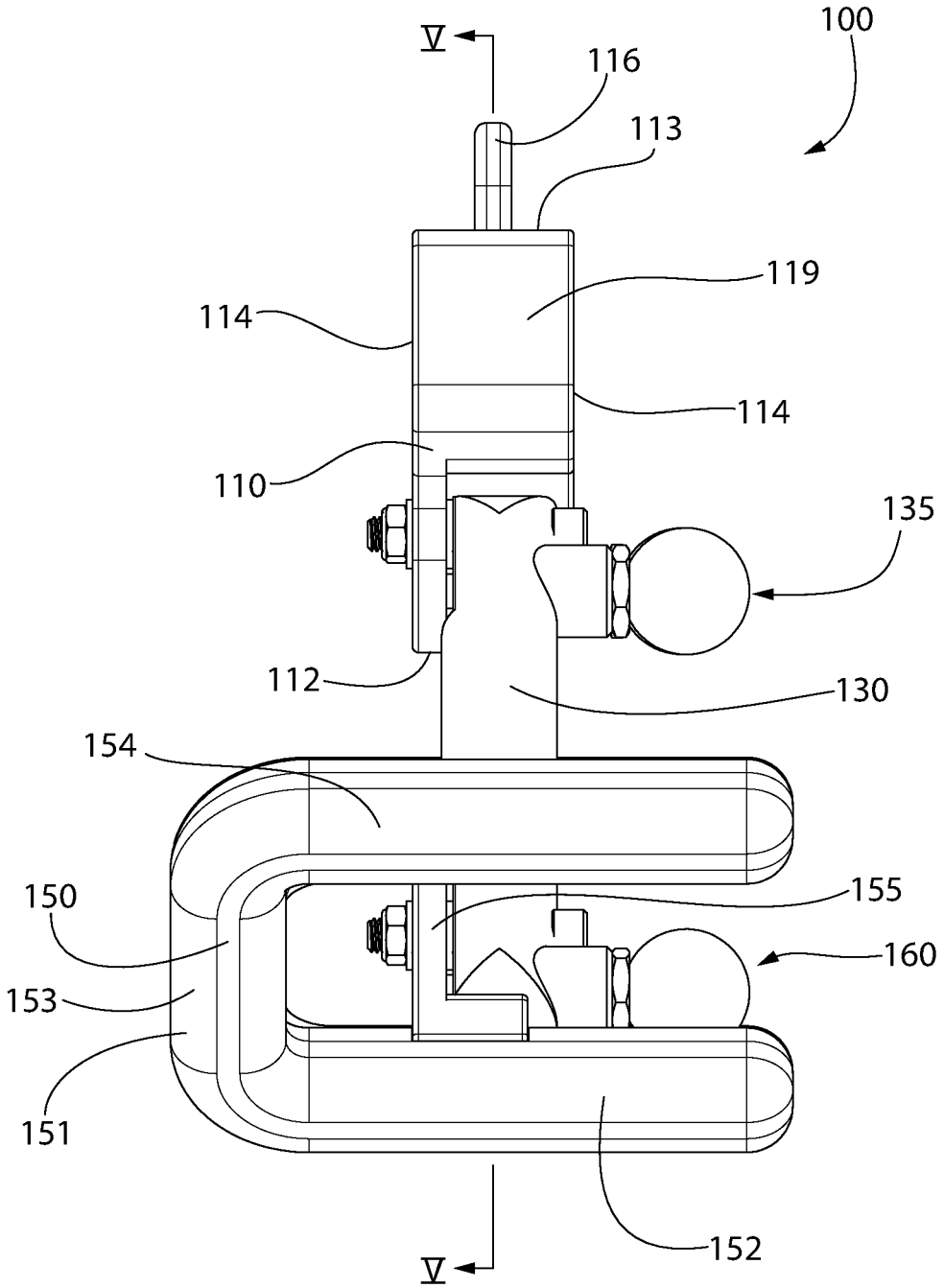
FIG. 4 is a side view of the multi-purpose exercise apparatus of FIG. 1.
Figure 5:
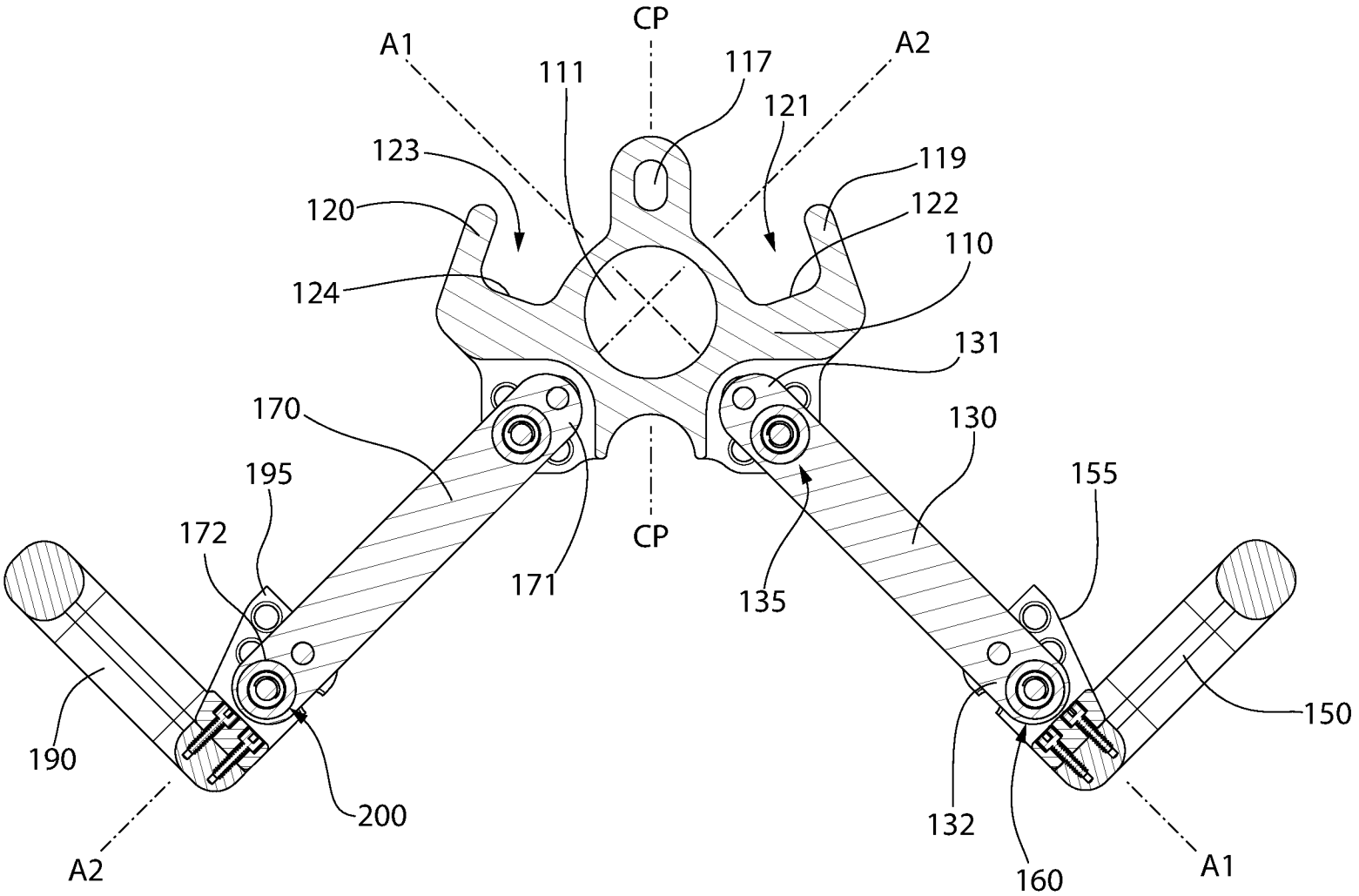
FIG. 5 is a cross-sectional view taken along line V-V of FIG. 4.

As mentioned above, the first arm 130 is pivotably coupled to the central hub 110 so as to be rotatable about a first arm pivot axis APA1 between a plurality of selectable first arm angular positions. Thus, the orientation or angular position of the first arm 130 relative to the central hub 110 can be modified between a plurality of selectable positions. In the exemplified embodiment, this includes a first maximum angular position (FIG. 7), a first minimum angular position (FIG. 8), and at least one first intermediate angular position (FIG. 3).

Figure 2:
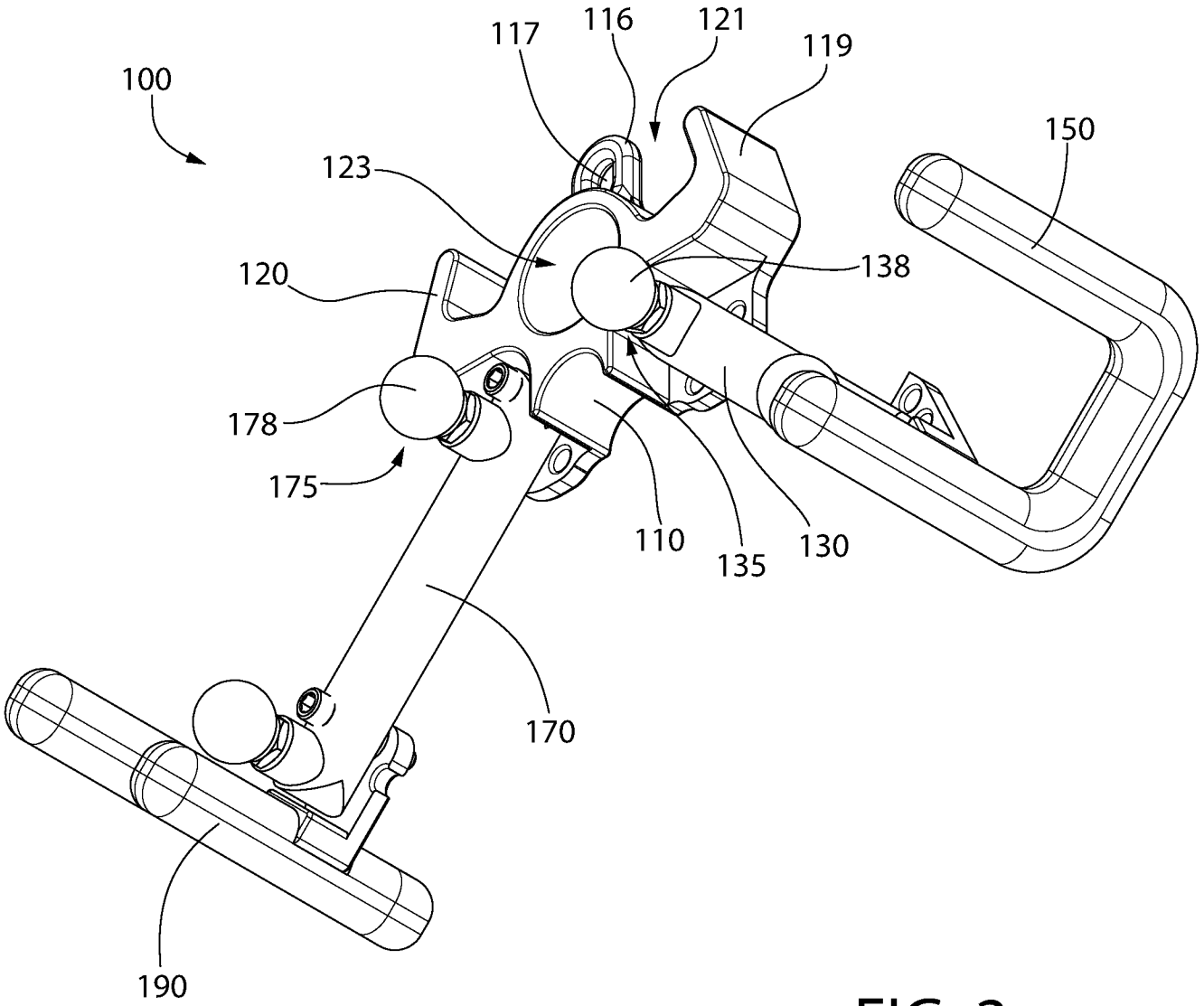
FIG. 2 is a rear perspective view of the multi-purpose exercise apparatus of FIG. 1.
Figure 7:
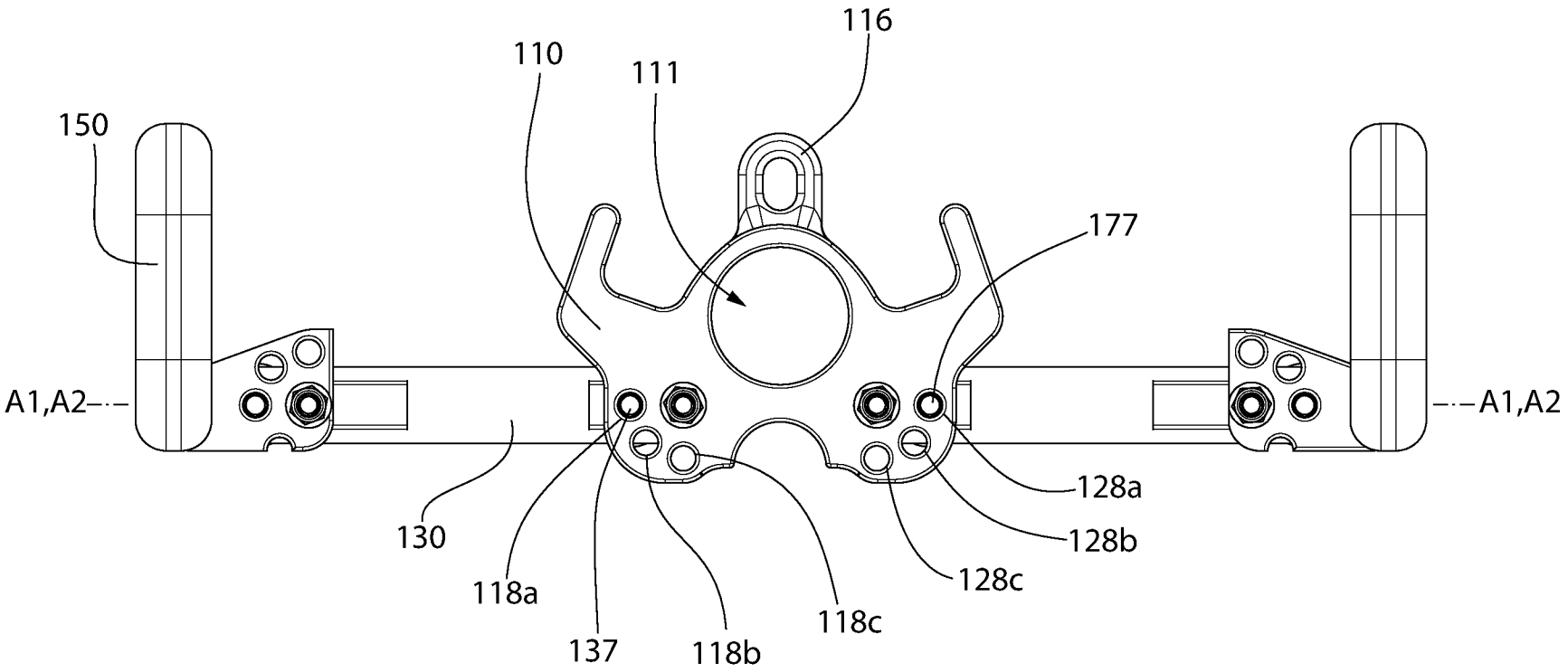
FIG. 7 is a front view of the multi-purpose exercise apparatus with the first and second arms in a first angular position.
Figure 8:
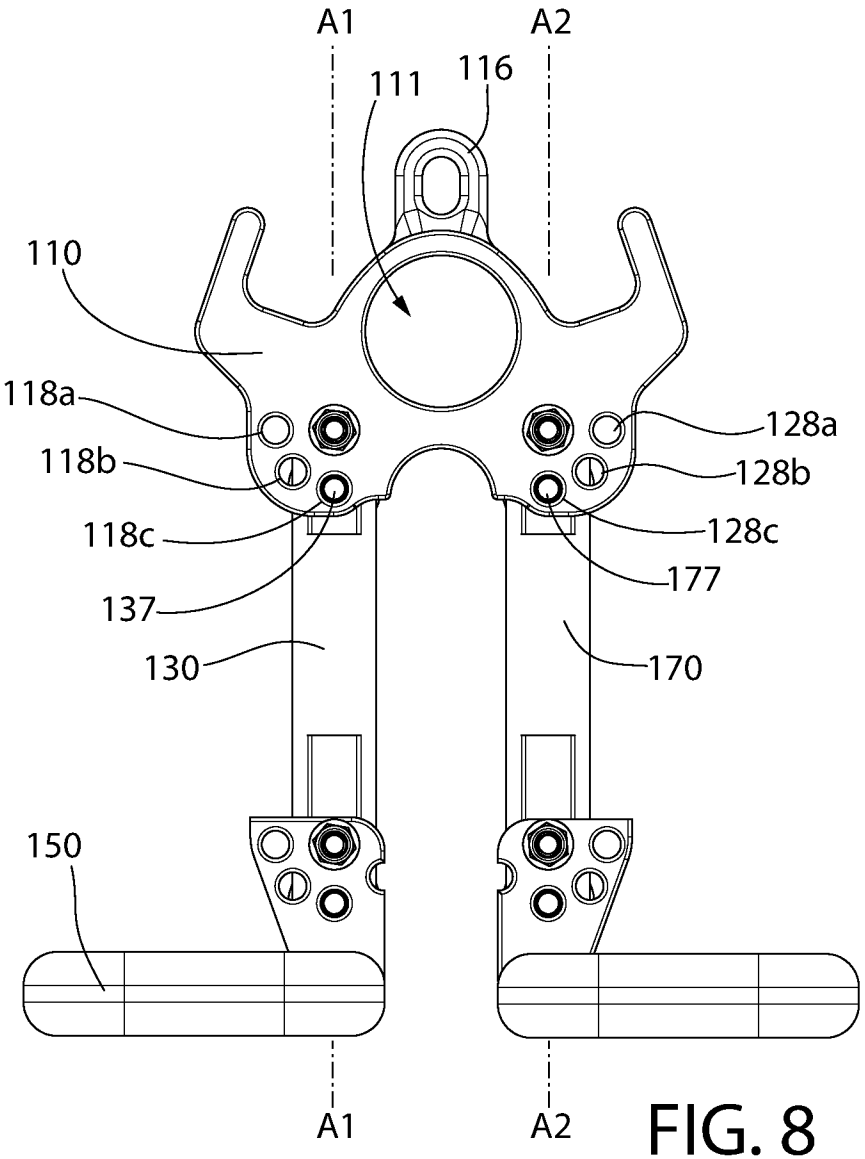
FIG. 8 is a front view of the multi-purpose exercise apparatus with the first and second arms in a second angular position.

In the exemplified embodiment, to achieve this rotational movement of the first arm 130 relative to the central hub 110, the central hub 110 comprises a first set of locking apertures 118*a-c* that interact with a first arm locking element 135 to lock the first arm 130 into any one of the selectable first arm angular positions. Thus, depending on which of the locking apertures 118*a-c* that the first arm locking element 135 interacts with, the first arm 130 can be locked into different positions. For example, as shown in FIGS. 1-3, when the first arm locking element 135 is engaged with the locking aperture 118*b*, the first arm 130 is in the intermediate angular position. As shown in FIG. 7, when the first arm locking element 135 is engaged with the locking aperture 118*a*, the first arm 130 is in the first maximum angular position. And finally, as shown in FIG. 8, when the first arm locking element 135 is engaged with the locking aperture 118*c*, the first arm 130 is in the first minimum angular position.

Figure 6A:
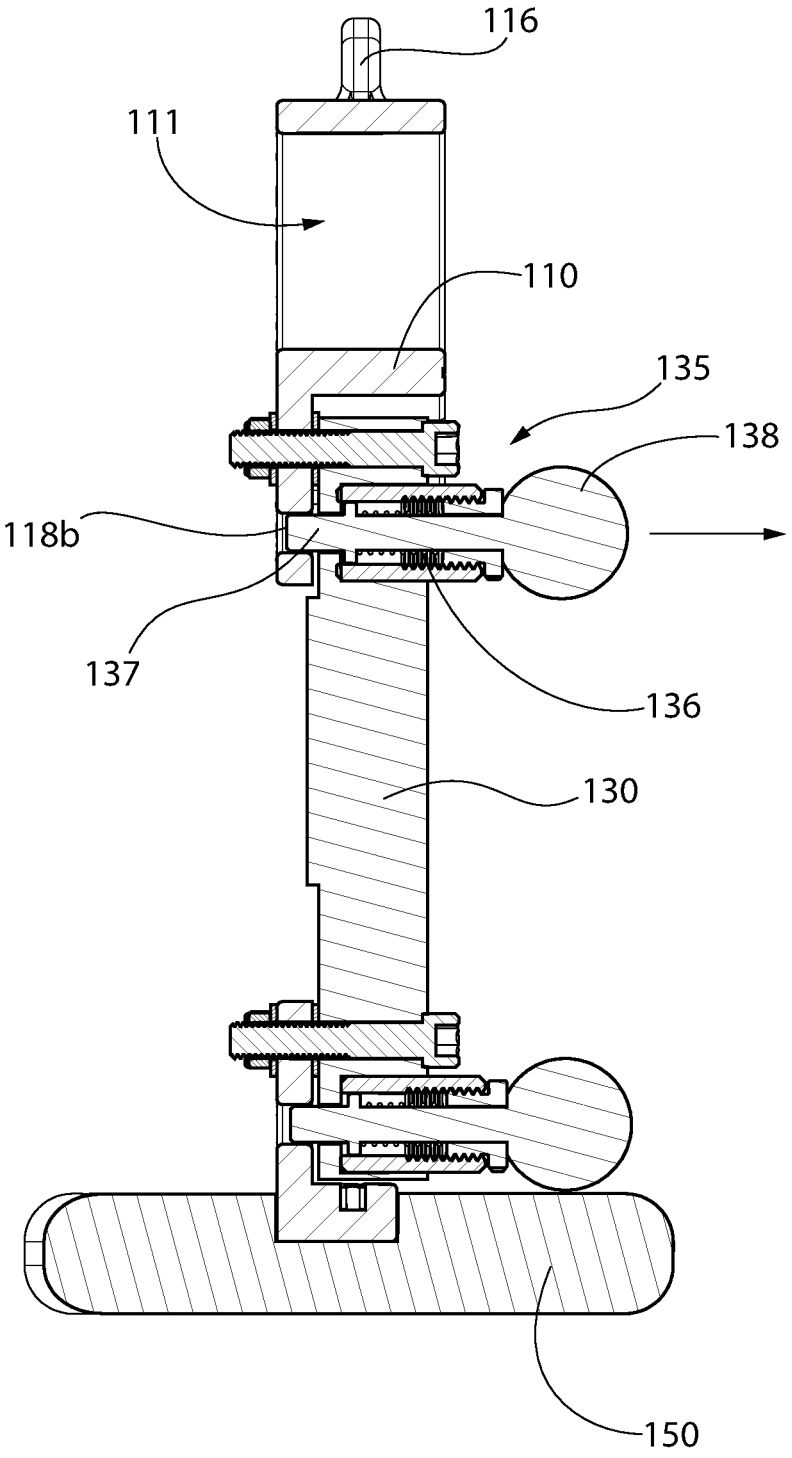
FIGS. 6A and 6B are cross-sectional views taken along line VI-VI of FIG. 3 illustrating the process of altering an angular position of the first arm of the multi-purpose exercise apparatus.
Figure 6B:
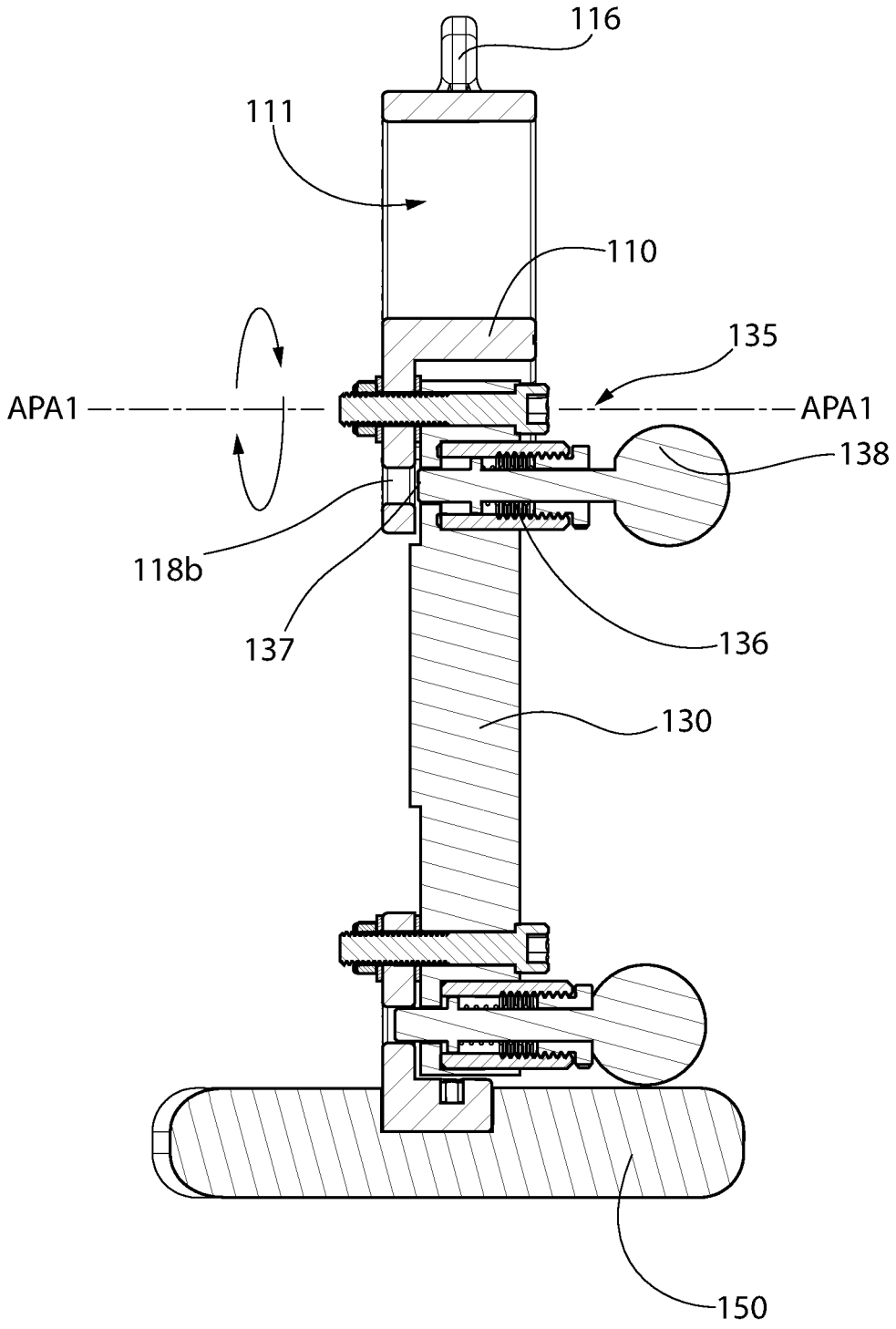

With reference to FIGS. 6A and 6B, operation of the first arm locking element 135 will be described. As seen in FIG. 6A, the first arm locking element 135 comprises a first resilient element 136 that biases the first arm locking element into the first arm locked state. More specifically, the first arm locking element 135 comprises the first resilient element 136, a locking pin 137, and an actuator 138, and the first resilient element 136 biases the locking pin 137 into the first arm locked state by biasing the locking pin 137 into one of the locking apertures 118*a-c*. In the exemplified embodiment, the first resilient element 136 is a spring. However, the first resilient element 136 may take on other structural forms so long as it is configured to bias the locking pin 137 into the first arm locked state as described herein. In the first arm locked state, the first arm 130 cannot be rotated relative to the central hub 110.

During operation, a user will pull on the actuator 138, which in the exemplified embodiment is a spherical shaped member for easy gripping by a user. Pulling on the actuator 138 will cause the locking pin 137 to be removed from the locking aperture 118*b* as shown when moving from FIG. 6A to FIG. 6B. Next, the user can freely rotate the first arm 130 relative to the central hub 110 between the various first arm locking positions because the locking pin 137 of the first arm locking element 135 is no longer engaged with one of the locking apertures 118*a-c*. Thus, the user can, with the actuator 138 pulled as shown in FIG. 6B, rotate the first arm 130 relative to the central hub 110 into a desired angular position. Once the desired angular position is reached, the user will release the actuator 137, which will cause the locking pin 137 to enter into the same one or a different one of the locking apertures 118*a-c*. At this point, the first arm 130 will once again be in the first arm locked state such that the first arm 130 cannot be rotated relative to the central hub 110.

As can be appreciated from the above, the first arm locking element 135 is alterable between a first arm locked state in which the first arm 130 is locked into a selected one of the plurality of selectable first arm angular positions and a first arm unlocked state in which the first arm 130 can be freely rotated between the plurality of selectable first arm angular positions.

The second arm 170 and its operation for movement are identical to the first arm 130, and thus the description of the second arm 170 and the components/elements that enable its rotational movement will be described more briefly than with the first arm. With that in mind, it should be appreciated that the description of the first arm 130 and all of the components and features that enable it to move as described herein are equally applicable to the second arm 170.

Referring to FIGS. 1-3 and 5, the second arm 170 will be described. The second arm 170 comprises a first end 171 and a second end 172 and extends along a second arm axis A2 from the first end 171 to the second end 172. In the exemplified embodiment, the second arm 170 has a fixed length. The first end 171 of the second arm 170 is pivotably coupled to the central hub 110. As shown in the figures, a screw and a bolt is used to couple the first end 171 of the second arm 170 to the central hub 110. However, as will be described in greater detail below, the second arm 170 is configured to be rotatable or pivotable relative to the central hub 110 to modify an angular position of the second arm 170. In that regard, in one particular implementation the second arm 170 may be coupled to the central hub 110 with a shoulder screw and bolt to allow for the aforementioned pivoting/rotation of the second arm 170 relative to the central hub 110 while maintaining the coupling therebetween. Of course, any other type of fastener that maintains the coupling between the second arm 170 and the central hub 110 while permitting the second arm 170 to pivot/rotate relative to the central hub 110 can be used. In the exemplified embodiment the second arm 170 is coupled to the rear surface 115 of the central hub 110.

As mentioned above, the second arm 170 is pivotably coupled to the central hub 110 so as to be rotatable about a second arm pivot axis APA2 between a plurality of selectable second arm angular positions. Thus, the orientation or angular position of the second arm 170 relative to the central hub 110 can be modified between the plurality of selectable positions. In the exemplified embodiment, this includes a second maximum angular position (FIG. 7), a second minimum angular position (FIG. 8), and at least one second intermediate angular position (FIG. 3).

In the exemplified embodiment, to achieve this rotational movement of the second arm 170 relative to the central hub 110, the central hub 110 comprises a second set of locking apertures 128*a-c* that interact with a second arm locking element 175 to lock the second arm 170 into any one of the selectable second arm angular positions. Thus, depending on which of the locking apertures 128*a-c* that the second arm locking element 175 interacts with, the second arm 130 can be locked into different positions. For example, as shown in FIG. 3, when the second arm locking element 175 is engaged with the locking aperture 128*b*, the second arm 170 is in the second intermediate angular position. As shown in FIG. 7, when the second arm locking element 175 is engaged with the locking aperture 128*a*, the second arm 170 is in the second maximum angular position. And finally, as shown in FIG. 8, when the second arm locking element 175 is engaged with the locking aperture 128*c*, the second arm 170 is in the second minimum angular position.

The second arm locking element 175 has the same features as the first arm locking element, which includes a second resilient element (not depicted, but it may be a spring or other similar element as noted above with regard to the first resilient element 136), a locking pin 177, and an actuator 178. The second resilient element biases the second arm locking element 170 into the second arm locked state by maintaining the locking pin 177 in position within one of the locking apertures 128*a-c*. A user can pull on the actuator 178 as described above with regard to the actuator 138 to remove the locking pin 177 from the locking apertures 128*a-c* which then allows the second arm 170 to be freely rotated relative to the central hub 110 between the various second arm angular positions. Releasing the actuator 178 then causes the second arm 170 to be locked into any one of various different angular positions as described herein and shown in the drawings. It should be appreciated that the illustrations of FIGS. 6A and 6B and the accompanying descriptions herein are applicable to the movement of the second arm 170 even though they are described with reference to the first arm 130.

As can be appreciated from the above, the second arm locking element 175 is alterable between a second arm locked state in which the second arm 170 is locked into a selected one of the plurality of selectable second arm angular positions and a second arm unlocked state in which the second arm 170 can be freely rotated between the plurality of selectable second arm angular positions.

Referring now briefly to FIGS. 3, 7, and 8 concurrently, the various angular positions of the first arm 130 and the second arm 170 relative to the central hub 110 will be described. By pulling the actuator 138 to adjust the angular position of the first arm 130, the first arm 130 can be moved into the first maximum angular position as shown in FIG. 7, whereby the locking pin 137 is disposed within the locking aperture 118*a*, the first minimum angular position as shown in FIG. 8, whereby the locking pin 137 is disposed within the locking aperture 118*c*, or an intermediate angular position as shown in FIGS. 1-3, whereby the locking pin 137 is disposed within the locking aperture 118*b*. Similarly, by pulling the actuator 178 to adjust the angular position of the second arm 170, the second arm 170 can be moved into the second maximum angular position as shown in FIG. 7, whereby the locking pin 177 is disposed within the locking aperture 128*a*, the second minimum angular position as shown in FIG. 8, whereby the locking pin 177 is disposed within the locking aperture 128*c*, or an intermediate angular position as shown in FIGS. 1-3, whereby the locking pin 177 is disposed within the locking aperture 128*b*. Furthermore, by adding additional locking apertures between the locking apertures 128*a* and 128*c*, more intermediate angular positions can be included and the number of angular positions at which the first and second arms 130, 170 may be locked is limited only by the space available to add more locking apertures. In some embodiments, there could even be a locking aperture above the locking apertures 118*a*, 128*a* so that the first and second arms 130, 170 can be moved beyond the maximum angular position of FIG. 7.

As shown in FIG. 7, when the first and second arms 130, 170 are in the first and second maximum angular positions, respectively, the first and second arm axes A1, A2 are substantially co-extensive along a single reference axis. As shown in FIG. 8, when the first and second arms 130, 170 are in the first and second minimum angular positions, respectively, the first and second arm axes A1, A2 are substantially parallel to one another in a spaced apart manner (substantially parallel being plus or minus up to 5°). Moreover, in the exemplified embodiment, when the first and second arms 130, 170 are in the first and second intermediate angular positions, respectively, the first and second arm axes A1, A2 are substantially perpendicular to one another (substantially perpendicular being plus or minus up to 5°).

Referring again to FIGS. 1-5, the first and second gripping members 150, 190 and their function/operation will be described. The first gripping member 150 is coupled to the second end 132 of the first arm 130. In the exemplified embodiment, this coupling is achieved with a screw (e.g., a shoulder screw) and a bolt in an identical manner to the way in which the first arm 130 is coupled to the central hub 110. This is because the first gripping member 150 is pivotably coupled to the first arm 130 so as to be rotatable about a first handle pivot axis HPA1 between a plurality of selectable first gripping angular positions. In the exemplified embodiment, the first gripping member 150 comprises a first U-shaped grip bar 151 having a first leg 152, a second leg 153, and a bight portion 154 extending between the first and second legs 151, 152. The first gripping member 150 further comprises a first connection plate 155 extending substantially perpendicular to the first leg 152 of the first U-shaped grip bar 151.

The first connection plate 155 is the portion of the first gripping member 150 that is coupled to the first arm 130. That is, the screw and bolt extend through the first arm 130 at or adjacent to the second end 132 of the first arm 130 and then extend through the first connection plate 155. Despite being coupled together, the first gripping member 150 remains pivotable/rotatable relative to the first arm 130 as described herein. The first connection plate 155 comprises a plurality of locking apertures 156*a-c* that are configured to lock the first gripping member 150 in one of a plurality of selectable first gripping angular positions, as described herein.

The apparatus 100 comprises a first gripping member locking element 160 that is alterable between a first gripping member locked state whereby the first gripping member 150 is locked into a selected one of the plurality of selectable first gripping angular positions and an unlocked state whereby the first gripping member 150 can be freely rotated between the plurality of selectable first gripping angular positions.

Figure 9A:
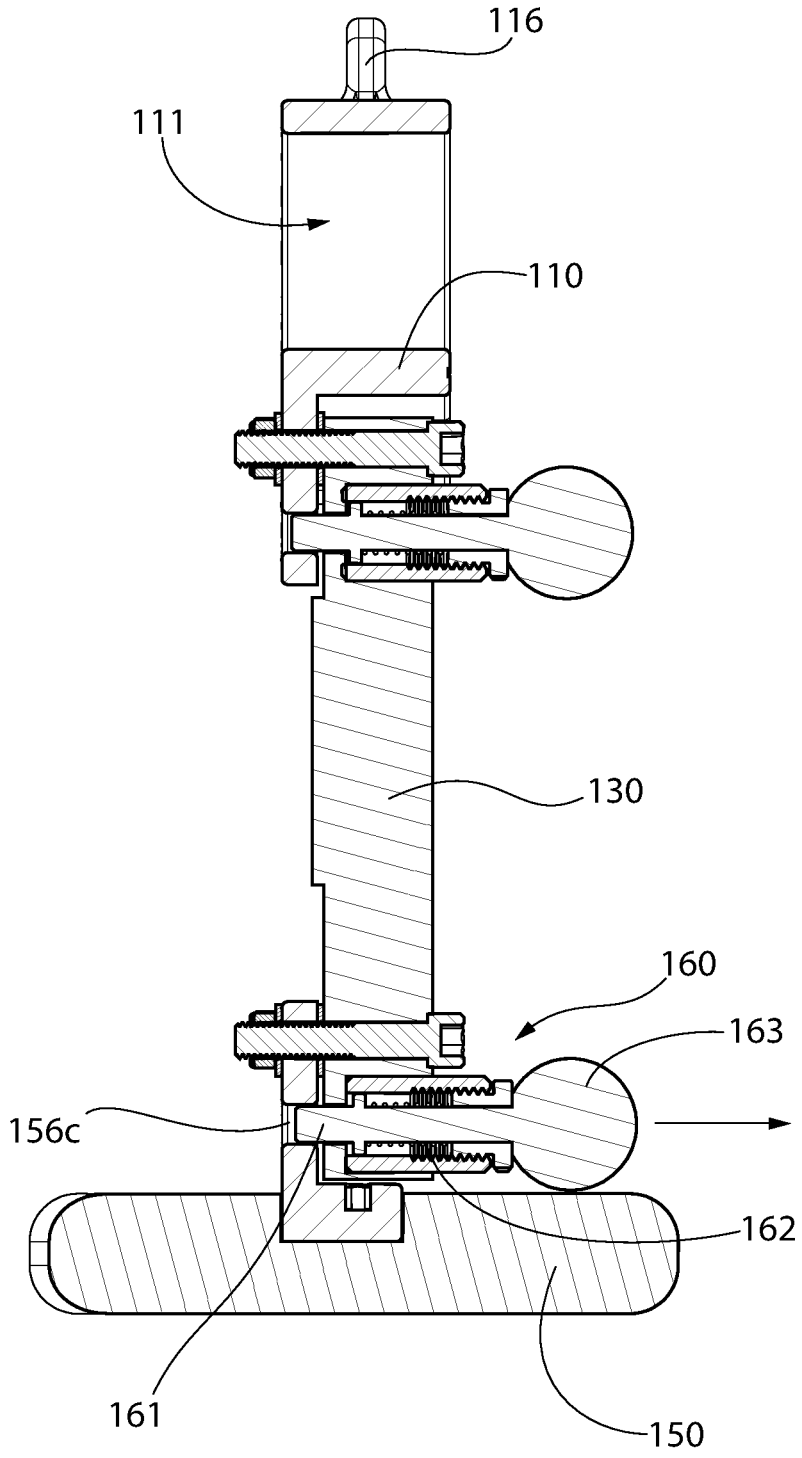
FIGS. 9A and 9B are cross-sectional views taken along line VI-VI of FIG. 3 illustrating the process of altering an angular position of the first gripping member of the multi-purpose exercise apparatus.
Figure 9B:
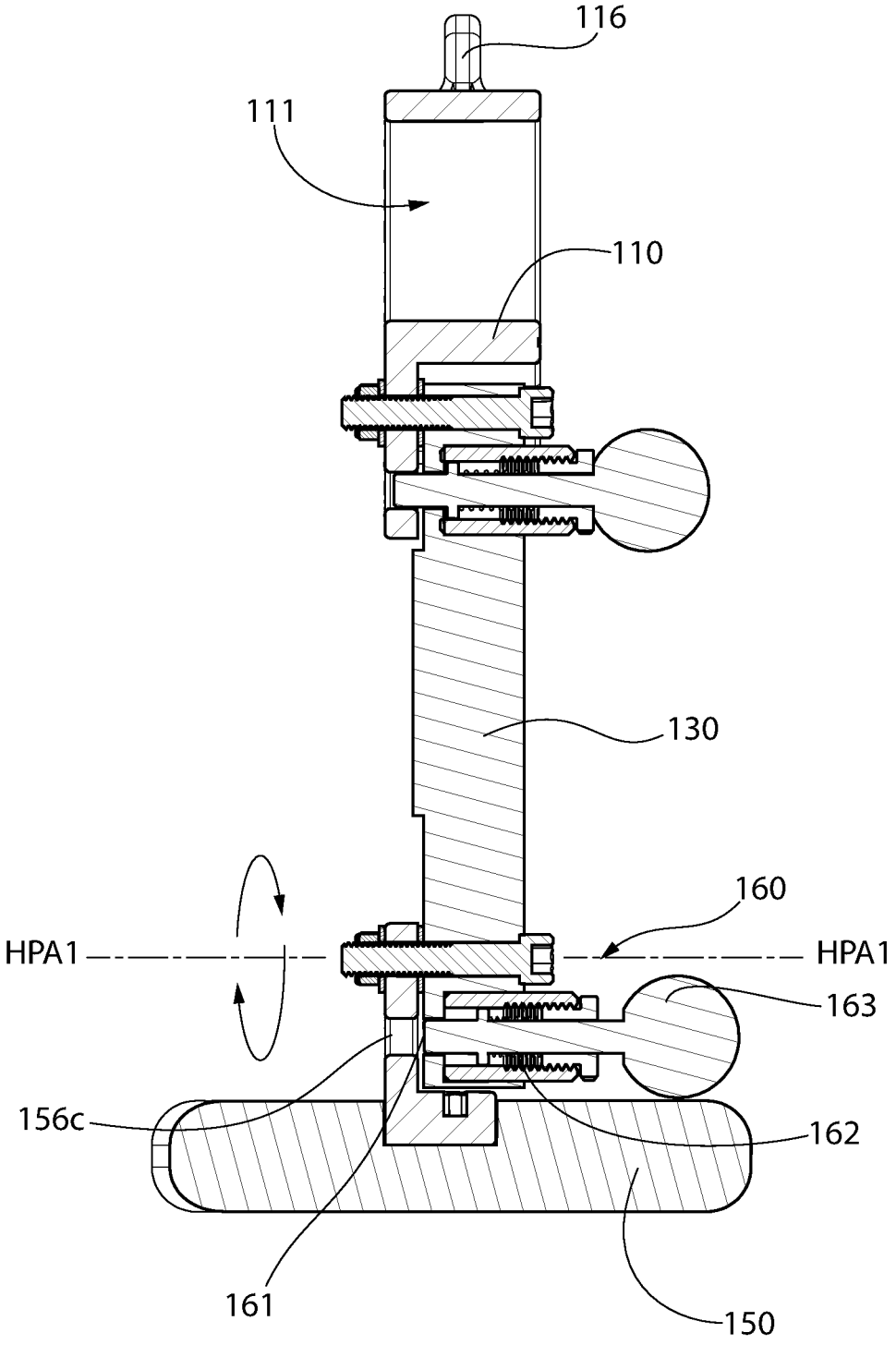

Referring to FIGS. 9A and 9B, the first gripping locking element 160 and its function will be described in greater detail. The first gripping locking element 160 comprises a first locking pin 161, a first resilient element 162, and a first actuator 163. In the exemplified embodiment, the first resilient element 162 is a spring, although it could take on other structural forms in other embodiments without affecting the operation described herein. When in the locked state as shown in FIG. 9A, the locking pin 161 is located within one of the locking apertures 156*c*. Upon a user pulling on the first actuator 163, which is a spherical shaped element in the exemplified embodiment for easy gripping by a user, the first locking pin 161 is removed from the locking aperture 156 which places the first gripping locking element 160 into the unlocked state. In the unlocked state, the first gripping member 150 can be freely rotated relative to the first arm 130 between the plurality of selectable first gripping angular positions. When the first gripping member 150 is in the desired first gripping angular position, the first actuator 163 is released and the first locking pin 161 becomes disposed within another one of the locking apertures (such as the locking aperture 156*a* or 156*b*. Thus, operation for pivoting of the first gripping member 150 relative to the first arm 130 is generally the same as operation for pivoting of the first arm 130 relative to the central hub, which was described in detail above with reference to FIGS. 6A and 6B.

Referring again to FIGS. 1-5, the second gripping member 190 will be described. The second gripping member 190 is coupled to the second end 172 of the second arm 170. In the exemplified embodiment, this coupling is achieved with a screw (e.g., a shoulder screw) and a bolt in an identical manner to the way in which the second arm 170 is coupled to the central hub 110. This is because the second gripping member 190 is pivotably coupled to the second arm 170 so as to be rotatable about a second handle pivot axis HPA2 between a plurality of selectable second gripping angular positions. In the exemplified embodiment, the second gripping member 190 comprises a first U-shaped grip bar 191 having a first leg 192, a second leg 193, and a bight portion 194 extending between the first and second legs 191, 192. The second gripping member 190 further comprises a second connection plate 195 extending substantially perpendicular to the first leg 192 of the first U-shaped grip bar 191.

The second connection plate 195 is the portion of the second gripping member 190 that is coupled to the second arm 170. That is, the screw and bolt extend through the second arm 170 at or adjacent to the second end 172 of the second arm 170 and then extend through the second connection plate 175. Despite being coupled together, the second gripping member 190 remains pivotable/rotatable relative to the second arm 170 as described herein. The second connection plate 195 comprises a plurality of locking apertures 196*a-c* that are configured to lock the second gripping member 190 in one of a plurality of selectable first gripping angular positions, as described herein.

The apparatus 100 comprises a second gripping member locking element 200 that is alterable between a second gripping member locked state whereby the second gripping member 190 is locked into a selected one of the plurality of selectable second gripping angular positions and an unlocked state whereby the second gripping member 190 can be freely rotated between the plurality of selectable second gripping angular positions. The operation of the second gripping locking member 200 is identical to the first gripping locking member 160 and thus it will not be described in detail herein, it being appreciated that the description of the first gripping locking member 160 and its operation is applicable thereto.

Figure 10:
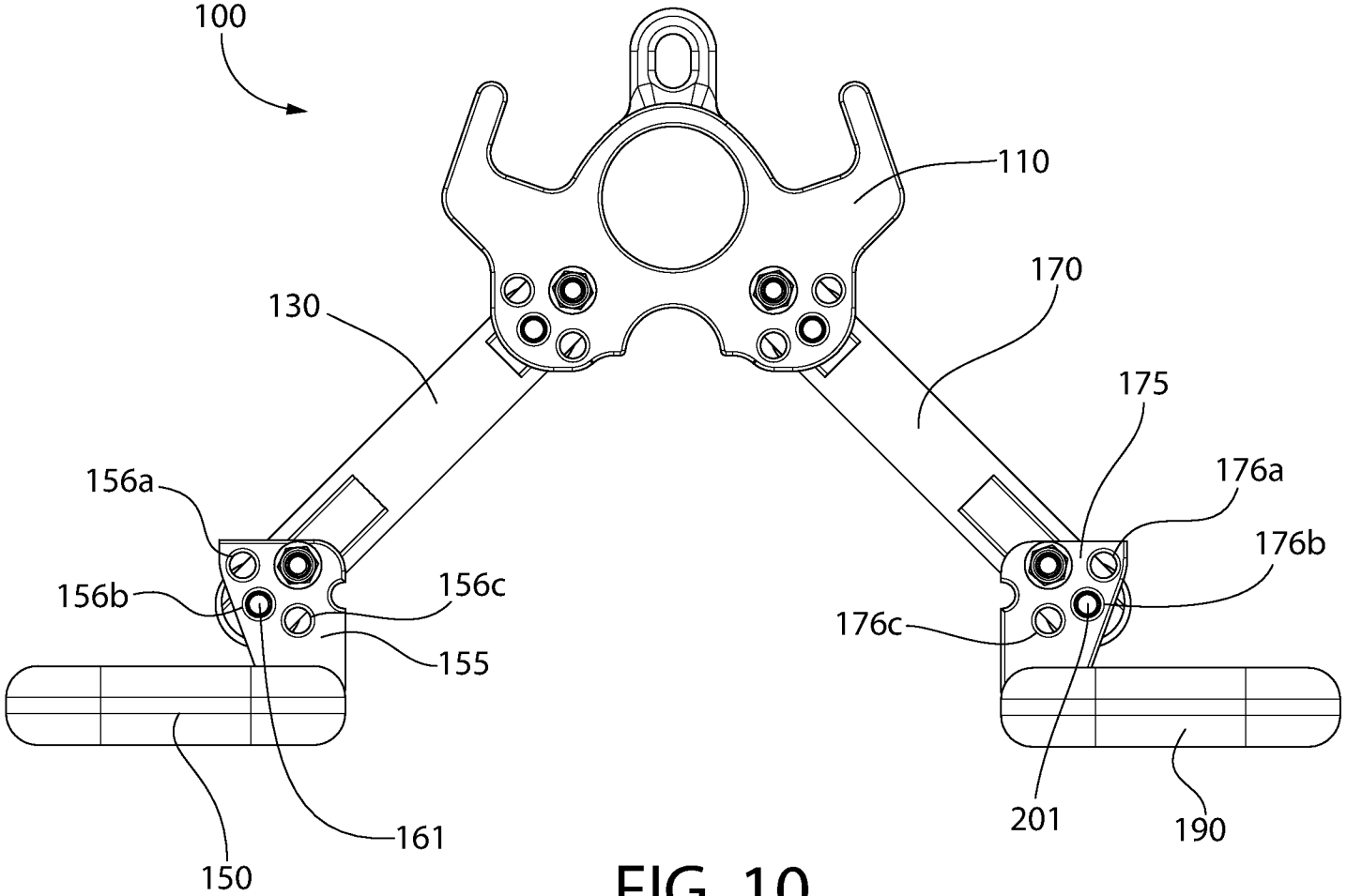
FIG. 10 is a front view of the multi-purpose exercise apparatus with the first and second gripping members in a first angular position.
Figure 11:
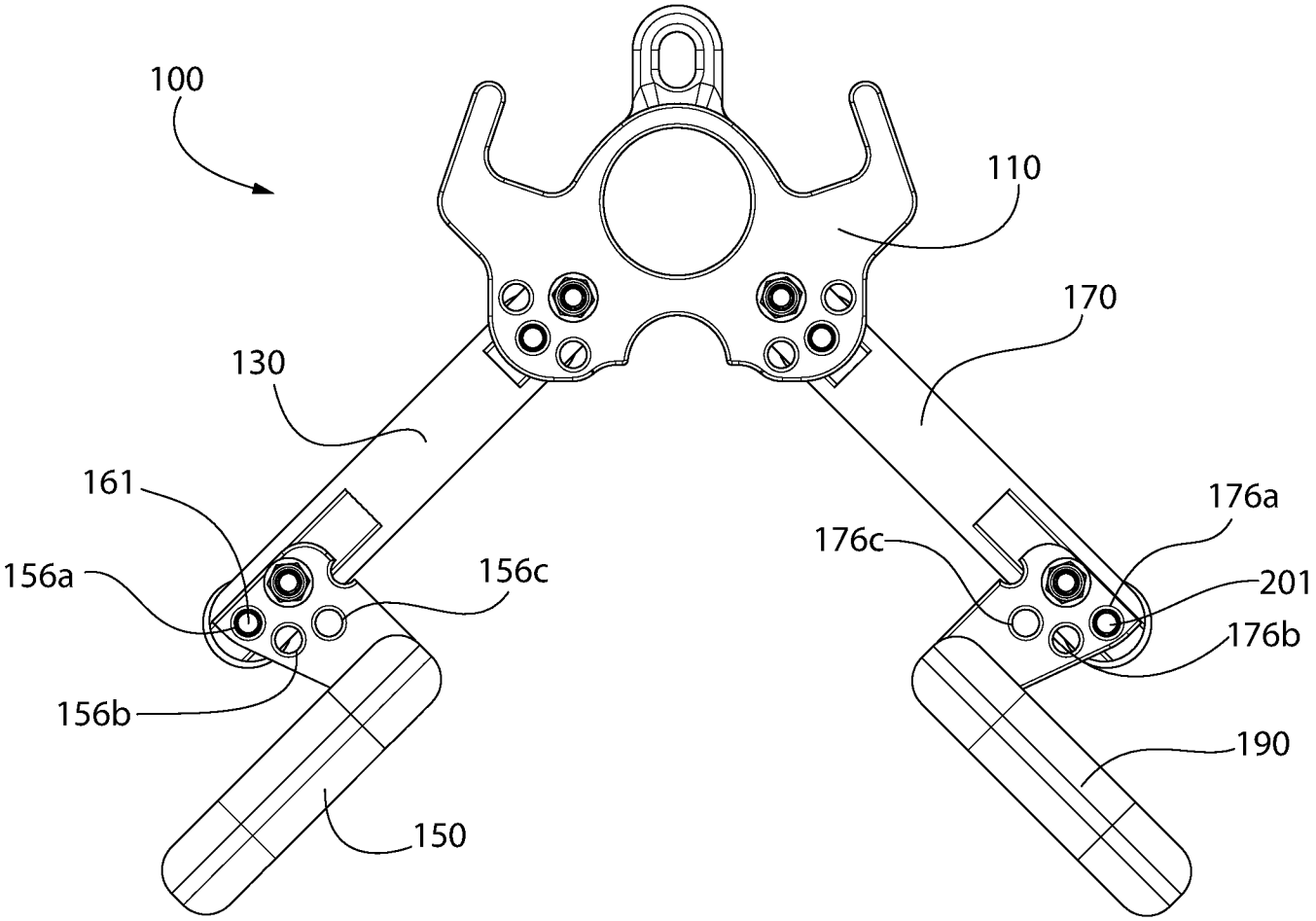
FIG. 11 is a front view of the multi-purpose exercise apparatus with the first and second gripping members in a second angular position.

Referring to FIGS. 3, 10, and 11, the different selectable first and second gripping angular positions of the first and second grip members 150, 190 will be described. In FIG. 3, the first and second gripping members 150, 190 are in a first and second maximum angular position, respectively. In the first maximum angular position, the first locking pin 161 of the first gripping member locking element 160 is located within the locking aperture 156*c* (best seen in FIG. 1). In the second maximum angular position, a second locking pin 201 of the second gripping locking member 200 is located within the locking aperture 196*c* (best seen in FIG. 1). In FIG. 11, the first and second gripping members 150, 190 are in a first and second minimum angular position, respectively. In the first minimum angular position, the first locking pin 161 of the first gripping member locking element 160 is located within the locking aperture 156*a*. In the second minimum angular position, the second locking pin 201 of the second gripping member locking element 200 is located within the locking aperture 176*a*. In FIG. 10, the first and second gripping members 150, 190 are in a first and second intermediate angular position, respectively. In the first intermediate angular position, the first locking pin 161 of the first gripping member locking element 160 is located within the aperture 156*b*. In the second intermediate angular position, the second locking pin 201 of the second gripping member locking element 200 is located within the aperture 196*b*. Additional intermediate angular positions may also be available by adding more locking apertures between the locking apertures 156*a* and 156*c* and between the locking apertures 196*a* and 196*c*.

By forming the apparatus 100 so that the first and second arms 130, 170 are pivotable relative to the central hub 110 and the first and second gripping members 150, 190 are pivotable relative to the first and second arms 130, 170, respectively, the versatility of the apparatus 100 is enhanced. The apparatus 100 can be used to perform countless different exercises and may be used by persons of different size/height due to the adjustability described herein.

FIGS. 12-14 illustrate different uses for the apparatus 100. First, in FIG. 12, the apparatus 100 is being used as a bar jack. That is, the apparatus 100 is being used to support a bar bell 300 above the ground so that weights can be loaded onto and unloaded from the bar bell 300. In that regard, in the exemplified embodiment the first arm 130 is in the intermediate angular position and the first gripping member 170 is in the maximum angular position. When so positioned, the orientation of the first slot 121 is ideal for holding a portion of a grip section 310 of the bar bell 300. Specifically, due to the angles of the floor 122 and hook member 119 as described above, the grip section 310 of the bar bell 300 will stay in the slot 121 with no fear of it falling out. The first arm 130 has an ideal length that keeps the bar bell 300 at a sufficient height above the floor so that the largest of weights can be placed onto the bar bell 300 with a small gap of 1-2 inches between the weight and the floor, as shown in FIG. 12. This keeps the bar bell 300 as low to the ground as possible while still allowing weights to be added thereto, which is ideal for deadlift exercises, for example.

It should be appreciated that the apparatus 100 can also be used as a bar jack with both of the first and second arms 130, 170 in the intermediate angular position (FIG. 3) or with both of the first and second arms 130, 170 in the minimum angular position (FIG. 8). In any of these positions, the slots 121, 124 and hooks 119, 120 are oriented in a proper manner to ensure that the bar bell 300 remains in the slots 121, 124 and will not readily fall out which could cause injury. Thus, there is even versatility in the ability of the apparatus 100 to operate as a bar jack.

FIG. 13 illustrates the apparatus 100 being used for an exercise whereby a weight bearing portion 320 of the bar bell 300 is inserted into and through the bar bell aperture 111 of the central hub 110 of the apparatus 100. When used in this manner, the apparatus 100 can be used for standing military T-bar presses, one arm bar rows, and T-bar rows, for example. The arms 130, 170 and the gripping members 150, 190 can be adjusted as needed depending on the exercise being performed and the size of the user performing the exercises to achieve maximum comfort to a user during performance of the exercise.

Finally, FIG. 14 illustrates the apparatus 100 being used for an exercise whereby a cable clip 400 of an exercise machine is coupled to the cable attachment member 116. When connected in this way, the apparatus 100 can be used for Lat pull downs, seated row, triceps pushdown/extension exercises, and the like. Modifying the first and second arm angular positions and the first and second gripping angular positions can be done depending on the exercise being performed and on the size of the user.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A multi-purpose exercise apparatus comprising:

a central hub having a central plane and a bar bell aperture, the bar bell aperture extending along a central axis that lies within the central plane and configured to slidably receive a weight bearing portion of a bar bell;

a first arm extending along a first arm axis and pivotably coupled to the central hub so as to be rotatable about a first arm pivot axis between a plurality of selectable first arm angular positions;

a first gripping member pivotably coupled to the first arm so as to be rotatable about a first handle pivot axis between a plurality of selectable first gripping angular positions;

a second arm extending along a second arm axis and pivotably coupled to the central hub so as to be rotatable about a second arm pivot axis between a plurality of selectable second arm angular positions; and a second gripping member pivotably coupled to the second arm so as to be rotatable about a second handle pivot axis between a plurality of selectable second gripping angular positions.

2. The multi-purpose exercise apparatus according to claim 1 further comprising a cable attachment member extending from the central hub and located along the central plane, the cable attachment member configured to be detachably coupled to a cable clip.

3. The multi-purpose exercise apparatus according to claim 2 wherein the cable attachment member comprises an eyelet defining a cable clip aperture.

4. The multi-purpose exercise apparatus according to claim 2 wherein the cable attachment member extends from a top surface of the central hub.

5. The multi-purpose exercise apparatus according to claim 1 further comprising:

a first hook member extending upward from the central hub, the first hook member defining a first slot configured to receive a grip section of the bar bell; and a second hook member extending upward from the central hub on an opposite side of the central plane as the first hook member, the second hook member defining a second slot configured to receive the grip section of the bar bell.

6. The multi-purpose exercise apparatus according to claim 5 wherein the first and second slots each comprise a floor that is oriented oblique relative to the central plane.

7. The multi-purpose exercise apparatus according to claim 5 wherein the first hook member extends along a first hook axis and the second hook member extends along a second hook axis, the first and second hooks oriented obliquely relative to the central plane so that the first and second hook axes converge towards the central plane as they extend in a direction away from the first and second gripping members.

8. The multi-purpose exercise apparatus according to claim 1 further comprising:

the plurality of selectable first arm angular positions comprising a first maximum angular position and a second maximum angular position;

the plurality of selectable second arm angular positions comprising a first maximum angular position and a second maximum angular position;

the first and second arm axes extending substantially parallel to one another in a spaced-apart manner when the first arm is in the first minimum angular position and the second arm is in the second minimum angular position; and each of the first and second arm axes being substantially co-extensive along a single reference axis when the first arm is in the first maximum angular position and the second arm is in the second maximum angular position.

9. The multi-purpose exercise apparatus according to claim 8 further comprising:

the plurality of selectable first arm angular positions comprising at least one intermediate angular position between the first maximum angular position and the second maximum angular position of the plurality of selectable first arm angular positions; and the plurality of selectable second arm angular positions comprising at least one intermediate angular position between the first maximum angular position and the second maximum angular position of the plurality of selectable second arm angular positions.

10. The multi-purpose exercise apparatus according to claim 1 further comprising:

the first gripping member comprising a first U-shaped grip bar; and the second gripping member comprising a second U-shaped grip bar.

11. The multi-purpose exercise apparatus according to claim 10 further comprising:

the first gripping member comprising a first connection plate extending substantially perpendicular to a first leg of the first U-shaped grip bar, the first connection plate pivotably coupled to the first arm; and the second gripping member comprising a second connection plate extending substantially perpendicular to a first leg of the second U-shaped grip bar, the second connection plate pivotably coupled to the second arm.

12. The multi-purpose exercise apparatus according to claim 1 further comprising:

a first arm locking element alterable between a first arm locked state in which the first arm is locked into a selected one of the plurality of selectable first arm angular positions and a first arm unlocked state in which the first arm can freely rotate between the plurality of selectable first arm angular positions, the first arm locking element comprising a first resilient element that biases the first arm locking element into the first arm locked state; and a second arm locking element alterable between a second arm locked state in which the second arm is locked into a selected one of the plurality of selectable second arm angular positions and a second arm unlocked state in which the second arm can freely rotate between the plurality of selectable second arm angular positions, the second arm locking element comprising a second resilient element that biases the second arm locking element into the second arm locked state.

13. The multi-purpose exercise apparatus according to claim 12 further comprising:

the central hub comprising a first set of locking apertures located on a first side of the central plane and a second set of locking apertures located on a second side of the central plane;

the first arm locking element comprising a locking pin that is configured to be received within one of the locking apertures of the first set of locking apertures depending on the first arm angular position of the first arm; and the second arm locking element comprising a locking pin that is configured to be received within one of the locking apertures of the second set of locking apertures depending on the second arm angular position of the second arm.

14. The multi-purpose exercise apparatus according to claim 1 wherein the first and second arms have a fixed length.

15. A multi-purpose exercise apparatus comprising:

a central hub having a central plane;

a first arm extending along a first arm axis and pivotably coupled to the central hub on a first side of the central plane so as to be rotatable about a first arm pivot axis between a plurality of selectable first arm angular positions;

a first arm locking element alterable between a first arm locked state in which the first arm is locked into a selected one of the plurality of selectable first arm angular positions and a first arm unlocked state in which the first arm can freely rotate between the plurality of selectable first arm angular positions;

a second arm extending along a second arm axis and pivotably coupled to the central hub on a second side of the central plane so as to be rotatable about a second arm pivot axis between a plurality of selectable second arm angular positions; and a second arm locking element alterable between a second arm locked state in which the second arm is locked into a selected one of the plurality of selectable second arm angular positions and a second arm unlocked state in which the second arm can freely rotate between the plurality of selectable second arm angular positions.

16. The multi-purpose exercise apparatus according to claim 15 further comprising an eyelet comprising a cable clip aperture extending from the central hub, the cable clip aperture configured to be detachably coupled to a cable clip of a weight machine.

17. The multi-purpose exercise apparatus according to claim 15 wherein the central hub further comprises a bar bell aperture, the bar bell aperture extending along a central axis that lies within the central plane and configured to slidably receive a weight bearing portion of a bar bell.

18. The multi-purpose exercise apparatus according to claim 15 further comprising:

a first hook member extending upward from the central hub on the first side of the central plane, the first hook member defining a first slot configured to receive a grip section of the bar bell; and a second hook member extending upward from the central hub on the second side of the central plane, the second hook member defining a second slot configured to receive the grip section of the bar bell.

19. The multi-purpose exercise apparatus according to claim 15 further comprising:

a first gripping member pivotably coupled to the first arm so as to be rotatable about a first handle pivot axis between a plurality of selectable first gripping angular positions; and a second gripping member pivotably coupled to the second arm so as to be rotatable about a second handle pivot axis between a plurality of selectable second gripping angular positions.

20. A multi-purpose exercise apparatus comprising:

a central hub having a central plane and a bar bell aperture, the bar bell aperture extending along a central axis that lies within the central plane and configured to slidably receive a weight bearing portion of a bar bell;

a cable attachment member extending from the central hub and located along the central plane, the cable attachment member comprising a cable clip aperture configured to be detachably coupled to a cable clip;

a first hook member extending upward from the central hub obliquely relative to the central plane, the first hook member defining a first slot configured to receive a grip section of the bar bell;

a second hook member extending upward from the central hub obliquely relative to the central plane on an opposite side of the central plane as the first hook member, the second hook member defining a second slot configured to receive the grip section of the bar bell;

a first arm comprising a first end and a second end, the first end being coupled to the central hub;

a first gripping member coupled to the second end of the first arm;

a second arm comprising a first end and a second end, the first end being coupled to the central hub; and a second gripping member coupled to the second end of the second arm.

* * * * *